US006025080A

United States Patent [19]

Soroushian

[11] Patent Number: 6,025,080

[45] Date of Patent: Feb. 15, 2000

[54] METAL MATRIX MATERIALS REINFORCED WITH SHAPE MEMORY FIBERS FOR ENHANCED DUCTILITY AND ENERGY ABSORPTION CAPACITY, AND METHOD OF MANUFACTURING SAME

[75] Inventor: Parviz Soroushian, Lansing, Mich.

[73] Assignee: DPD, Inc., Lansing, Mich.

[21] Appl. No.: 08/986,402

[22] Filed: Dec. 8, 1997

[51] Int. Cl.[7] ..... B32B 5/12

[52] U.S. Cl. ..... 428/614; 428/608; 428/611

[58] Field of Search ..... 428/614, 608, 428/611

[56] References Cited

U.S. PATENT DOCUMENTS

| | | |
|---|---|---|
| 5,508,116 | 4/1996 | Barrett . |
| 5,611,874 | 3/1997 | Zadno-Azizi et al. . |
| 5,614,305 | 3/1997 | Paine et al. . |

OTHER PUBLICATIONS

Shaw, J.A. and Kyriakldes, S., "Material Characterization of Niti Shape Memory Alloys: I Experiments," AMD–vol. 200/MD–vol. 57, Plastic and Fracture Instabilities in Materials, ASME, 1995, pp. 81–84.

*Primary Examiner*—Deborah Jones
*Assistant Examiner*—Jason Savage

[57] ABSTRACT

Shape-memory fibers are incorporated into a metal matrix material with a level of fiber-to-matrix bonding so that upon localized failure of matrix under load, the strains in fibers debond them from the matrix to the extent that fibers do not all rupture at the location of matrix failure. The pull-out process of fibers ruptured away from the matrix failure location provides the composite material with substantially increased ductility and energy absorption capacity after localized failure of the matrix. Pre-tensioning of shape-memory fibers impose sustained stresses on matrix which enhance the strength and energy absorption capacity of the composite material. The shape-memory fibers may be incorporated into a metal matrix at their end so that fibers pull out from the matrix under load and provide an energy-absorbing assembly.

14 Claims, 6 Drawing Sheets

METAL MATRIX MATERIALS REINFORCED WITH SHAPE MEMORY FIBERS FOR ENHANCED DUCTILITY AND ENERGY ABSORPTION CAPACITY, AND METHOD OF MANUFACTURING SAME

This invention was made with U.S. government support under DAAH04-96-C0070 awarded by the U.S. Army Research Office. The U.S. government has certain rights in the invention.

BACKGROUND OF THE INVENTION

1. Field of the Invention

The invention is generally related to fiber reinforced metal matrix materials. Particularly, the invention is directed to a great improvement in the ductility of metal matrix materials.

2. Description of the Relevant Art

Ductility and energy absorption capacity are governing criteria for the selection of materials and structural systems in diverse applications including crashworthiness and impact resistance. In fiber reinforced composites with different matrices, frictional fiber pull-out offers the potential to absorb substantial energy. This potential source of energy absorption is, however, largely untapped because localized failure of matrix leads to localized deformation and rupture of fibers, which prevent activation of the frictional pullout process.

Shape-memory alloys will, after an apparent plastic deformation, return to their original shape when heated. The same class of materials, in a certain temperature range, can be strained up to approximately 10% and still return to their original shape when unloaded. These effects are called shape-memory and pseudoelasticity. Both effects depend on the occurrence of a specific type of phase change known as martensitic transformation. Pseudoelastic strains, which can be as large as 10%, are distributed within the material volume as are the relatively small elastic strains. Pseudoelastic strains nucleate at critical sites, including highly stressed sites, and then gradually spread along the length of the pseudoelastic fiber, eventually affecting the whole volume of the fiber (Shaw, J. A. and Kyriakldes, S., *Material Characterization of NiTi Shape Memory Alloys: I Experiments,* AMD-Vol. 200/MD-Vol. 57, Plastic and Fracture Instabilities in Materials, ASME, 1995, pp. 81–84). In conventional ductile metals such as steel, strains of the order of few percent, which are plastic strains, tend to localize and have little effect on the bulk volume of the material. Examples of shape-memory materials include nickel-titanium alloys, copper-based alloys such as Cu—Zn—Al and Cu—Al—Ni, and iron-based alloys.

Poisson's ratio is the ratio of transverse to longitudinal strains as the material is subjected to longitudinal stresses. The distributed nature of pseudoelasticity implies that the transverse strains associated with the Poisson's effect are also distributed.

Shape memory alloys have been used in a variety of composite materials. U.S. Pat. No. 5,614,305 to Paine et al. discloses hybridization of a brittle fiber reinforced polymer composite laminate with shape memory fibers which exhibit martensite phase transformation for the improvement of impact strength and resistance to delamination and perforation. These improvements are obtained through dissipation of strain energy in shape memory fibers as they undergo stress-induced martensite phase transformation. U.S. Pat. No. 5,508,116 to Barrett discloses a metal matrix composite exhibiting shape memory characteristics, which comprises shape memory alloy particles and metal particles consolidated to form a unitary mass. U.S. Pat. No. 5,611,874 to Zadno-Azizi et al. discloses a composite structure with shape memory cladding which exhibits shape memory characteristics and benefits from such physical characteristics of the body material as high conductivity, weldability, and solderability.

U.S. Pat. No. 5,614,305 to Paine et al. improves the impact strength, and delamination and perforation resistance of polymer matrix composites through martensite phase transformation in shape memory fibers at relatively small deformations. The associated improvements in ductility and energy absorption capacity are relatively small when compared with those obtained in this invention with metal matrices reinforced with shape memory fibers where the pull-out process of such fibers from the metal matrix dissipates substantial energy at large deformations. U.S. Pat. No. 5,614,305 to Paine et al. seeks to provide local improvements in the performance of polymer matrix composites, while this invention uses the full volume of metal matrices and shape memory fibers to provide global improvements in ductility and energy absorption capacity for applications such as crashworthiness and blast- or earthquake-resistant structures.

SUMMARY OF THE INVENTION

It is an object of this invention to provide a composite material having superior ductility and energy absorption capacity that includes shape memory fibers.

It is another object of this invention to provide mechanisms for preventing rupture of fibers at the location of matrix rupture in fiber reinforced composites.

It is another object of this invention to provide mechanisms for increasing the energy absorption through frictional pull-out of fibers in fiber reinforced composites.

It is another object of this invention to provide mechanisms for increasing the post-peak tensile resistance and deformation capacity of fiber reinforced composites relying on the frictional pull-out process of shape memory fibers.

Applicant has discovered that shape memory fibers, when embedded in metal matrices, can resist rupture at critical locations where the matrix fails and, after they rupture away from the location of matrix rupture, can undergo a pull-out process which sustains substantial frictional pull-out resistance and provides distinctly high ductility and energy absorption capacity. Comparative tension test results have demonstrated major improvements in deformation capacity, and post-peak load resistance and energy absorption capacity of metal matrix composites reinforced with shape memory fibers.

According to the invention, there is provided a composite material and method of manufacturing same where a metal matrix is reinforced with a plurality of shape memory fibers such that when the matrix experiences a localized failure therein, associated fiber tensile strains in ones of said shape memory fibers extending through said localized failure cause debonding of said ones of said fibers from the matrix to an extent that said ones of said fibers do not rupture at said localized failure.

DETAILED DESCRIPTION OF THE PREFERED EMBODIMENTS OF THE INVENTION

Figure 1:
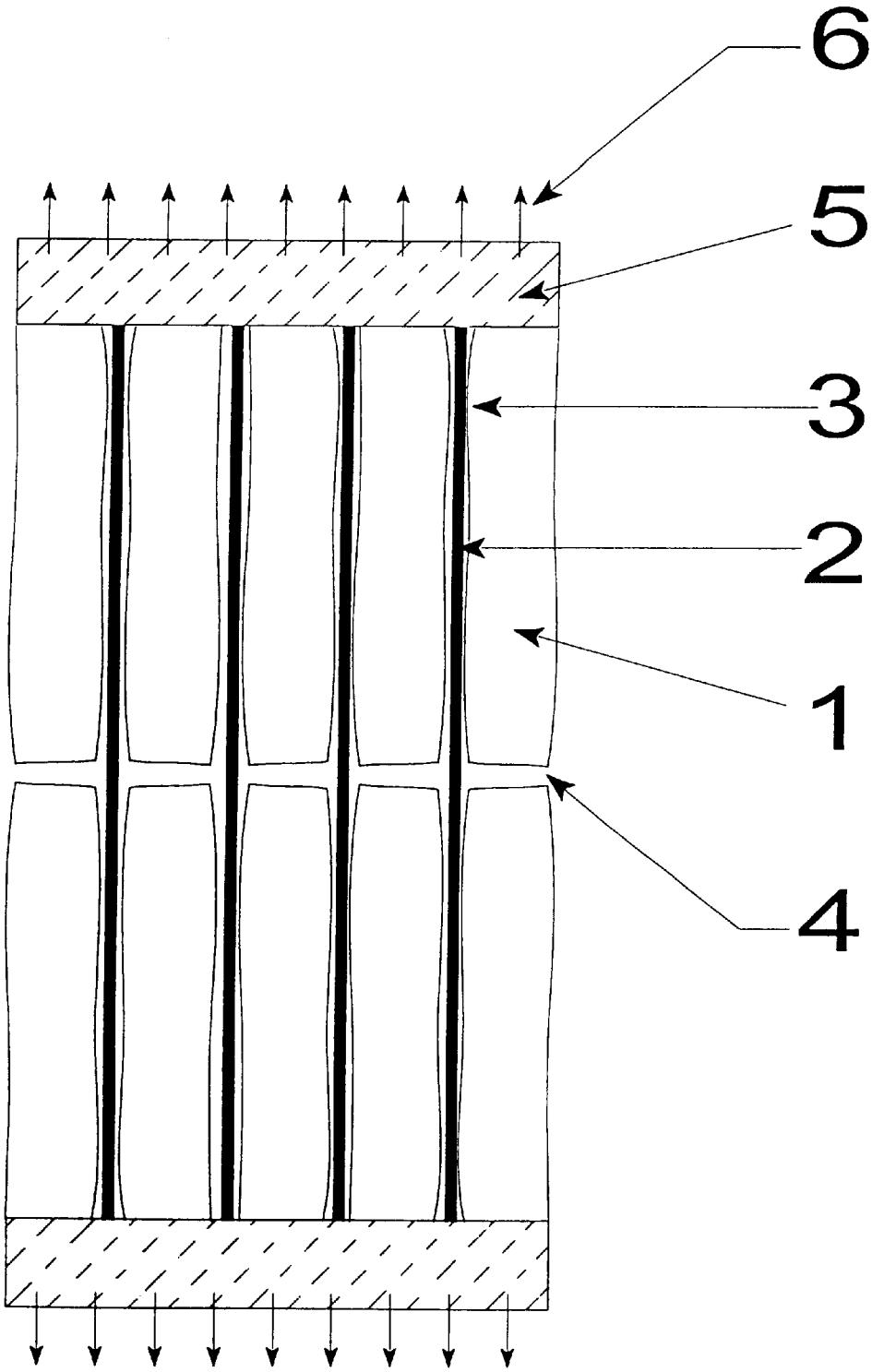
FIG. 1 is longitudinal section of a pseudoelastic fiber reinforced composite under tension, with pseudoelastic strains propagated along the fiber length, and fibers debonded from the matrix along their length. The size of the fibers is exaggerated in the drawing to facilitate the explanation of the invention.
Figure 2:
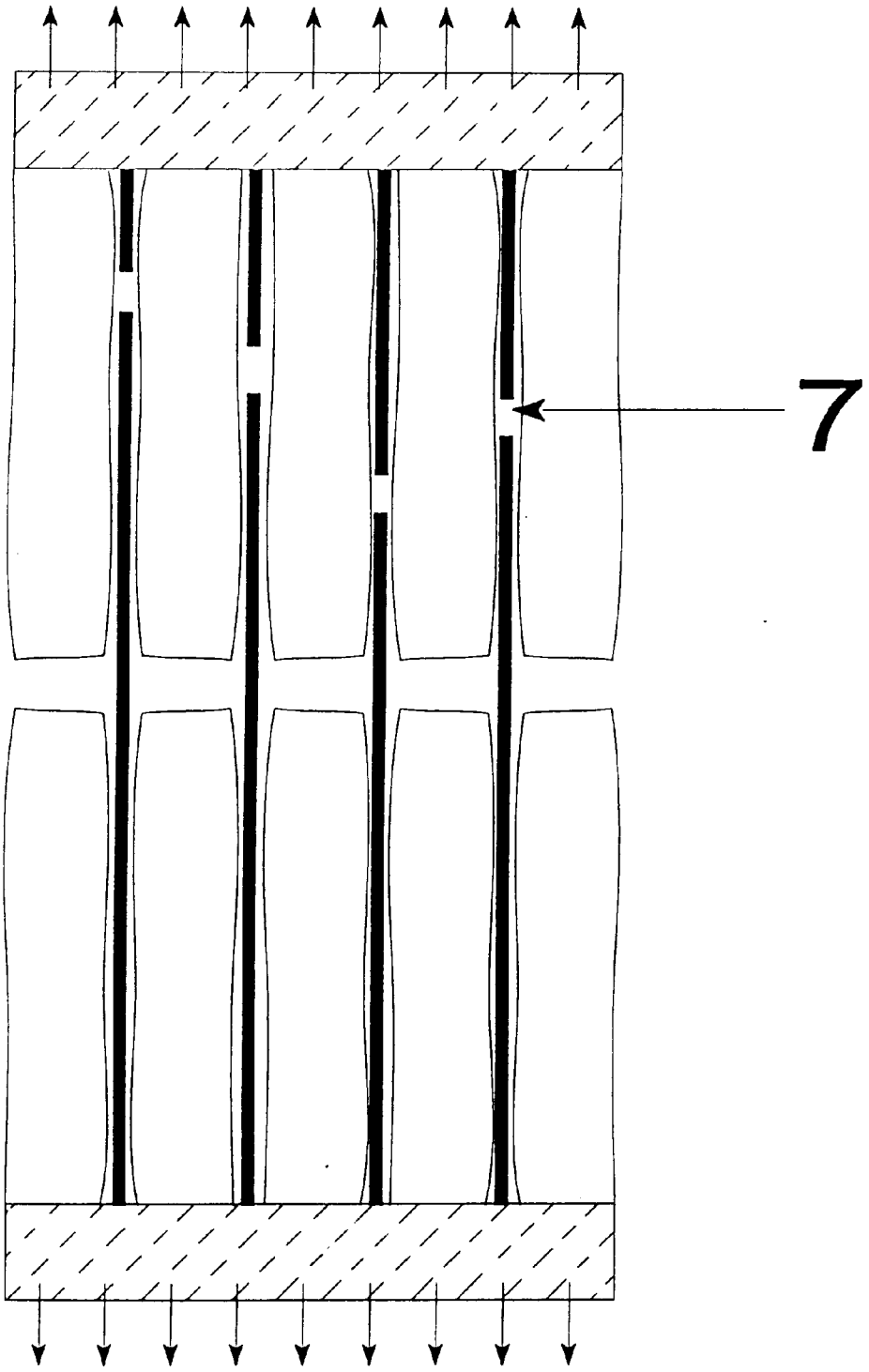
FIG. 2 is longitudinal section of a pseudoelastic fiber reinforced composite under tension, with debonded fibers ruptured at random locations along their length.
Figure 3:
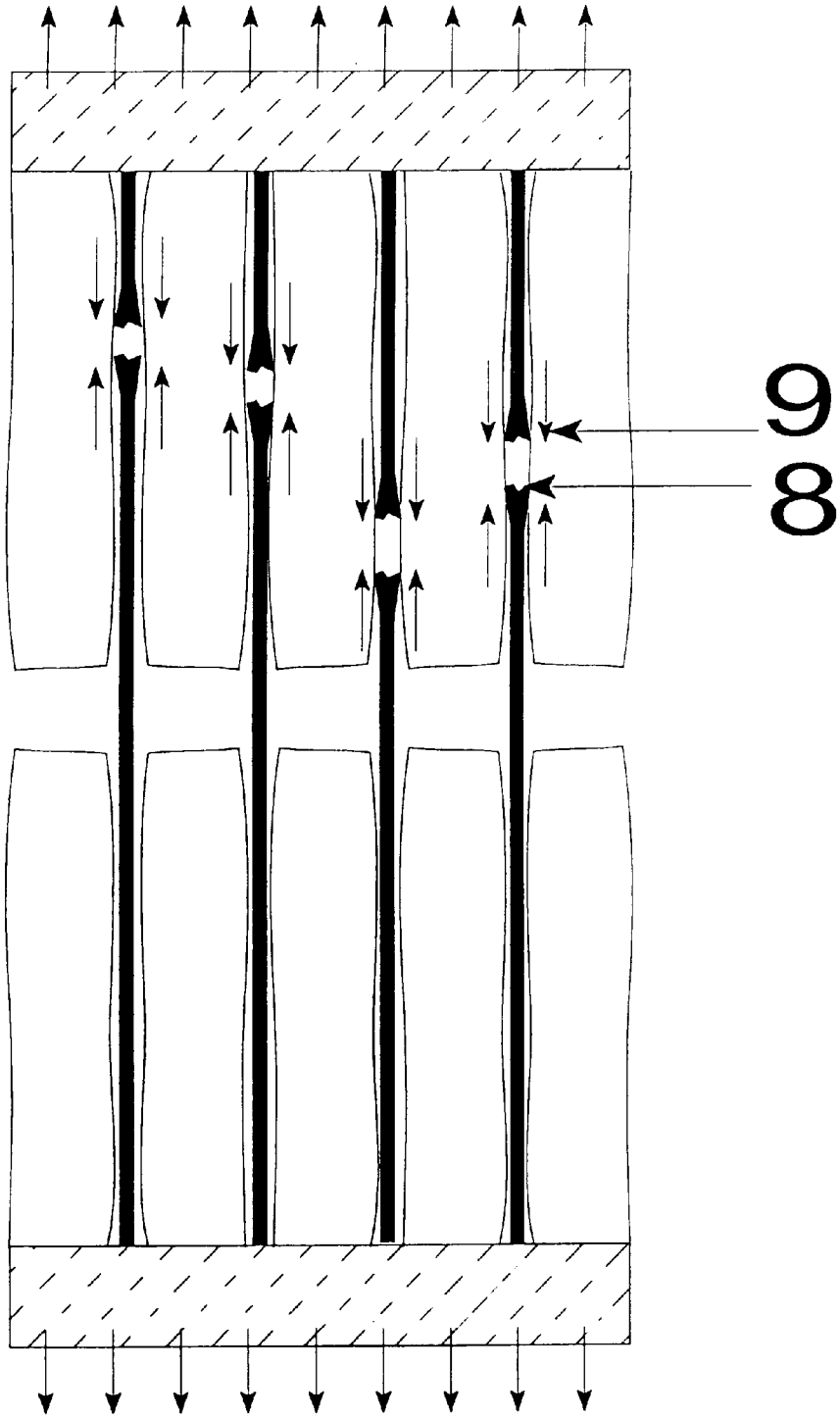
FIG. 3 is longitudinal section of a pseudoelastic fiber reinforced composite under tension, where ruptured fibers have recovered their pseudoelastic strains and have restored contact with the matrix near rupture locations.

Pseudoelastic strains in shape memory alloys nucleate at critical sites and then gradually spread along the length of pseudoelastic fibers, eventually affecting the whole volume of pseudoelastic fibers (Shaw, J. A. and Kyriakldes, S., *Material Characterization of NiTi Shape Memory Alloys: I Experiments,* AMD-Vol. 200/MD-Vol. 57, Plastic and Fracture Instabilities in Materials, ASME, 1995, pp. 81–84). In the context of a matrix material reinforced with poseudoelastic fibers and subjected to tension this implies that, upon rupture of the matrix, fibers undergo large pseudoelastic strains at the location of matrix rupture. Such large pseudoelastic strains are accompanied with large transverse strains resulting from the Poisson's effect, which tend to reduce the diameter of pseudoelastic fibers. The reduction of fiber diameter stresses the fiber-matrix interface and leads to partial or full debonding of fibers from the matrix. As debonding progresses from the matrix rupture location along the fiber length, fiber stresses increase and thus pseudoelastic strains progress along the fiber length away from the matrix rupture location. Eventually, pseudoelastic fibers partially or fully debond from the matrix along their full length as shown in FIG. 1. Tensile force 6 is applied in FIG. 1 through end grips 5, while the matrix 1 is shown ruptured at location 4, and fibers 2 are debonded from the matrix at interfaces 3. The pseudoelastic fibers then largely behave as individual fibers subjected to tension, with limited coupling with the matrix. The eventual rupture of the fibers, shown in FIG. 2, under increasing tensile load levels are thus largely independent of the location of matrix rupture and occur at random locations along the fiber lengths. Rupture of fibers relieves the fiber tensile stresses at the rupture location and prompts recovery of pseudoelastic strains at the rupture location, noting that large pseudoelastic strains are fully recoverable upon stress removal. The recovery of pseudoelastic strains is accompanied with the recovery of transverse strains associated with the Poisson's effect. This means that fiber rupture prompts recovery of the original diameter, as shown in FIG. 3, near the rupture locations 8 of fibers, which partially restores contact between the ruptured fiber and matrix near these locations 8 in FIG. 3. Contact between pseudoelastic fiber ends and the matrix restores frictional forces 9 at fiber-matrix interfaces as shown in FIG. 3. Further tensile stresses are then resisted by the ruptured fibers which undergo frictional pull-out. The ductile composite materials according to the invention provide substantial deformation capacity as they resist tension during fiber pull-out until all fibers pull out of the matrix. With conventional fibers which exhibit either an elastic behavior to failure, such as glass fibers, or an elastic-plastic behavior to failure, such as steel fibers, fibers tend to rupture near the location of matrix rupture, and composites reinforced with such conventional fibers thus do not offer the large deformation capacity associated with random rupture followed by frictional pull-out process of pseudoelastic fibers in composites.

Different metal matrices, including those based on aluminum, copper, iron, nickel, titanium and magnesium, can be used in the invention. Various shape memory fibers can be used in the invention, including groups consisting essentially of Ni, Ag, Au, Cd, In, Ga, Si, Ge, Sn, Sb, Zn, Nb, Cu, Co, Fe, Mn, Pt, Al, Ti, Cr, Be, C and Tl, and combinations thereof The processing temperature-time history of metal matrix composites influence fiber properties through such effects as annealing and aging.

INVENTION AND COMPARISON EXAMPLES

Figure 4:
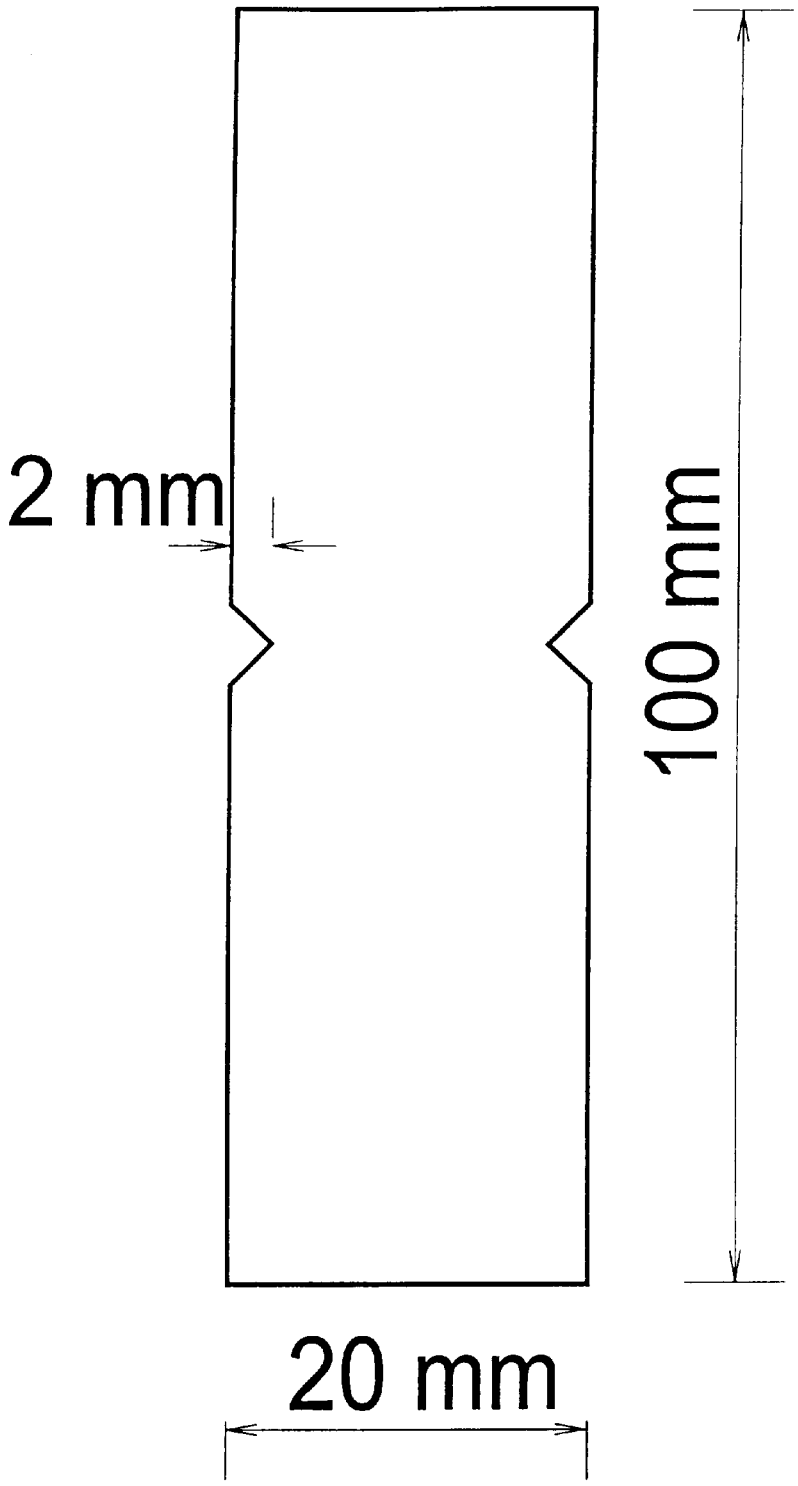
FIG. 4 is a plan view of a notched specimen used in tension testing of metal matrix composites reinforced with pseudoelastic and steel fibers, wherein dimensions of same are indicated.
Figure 5:
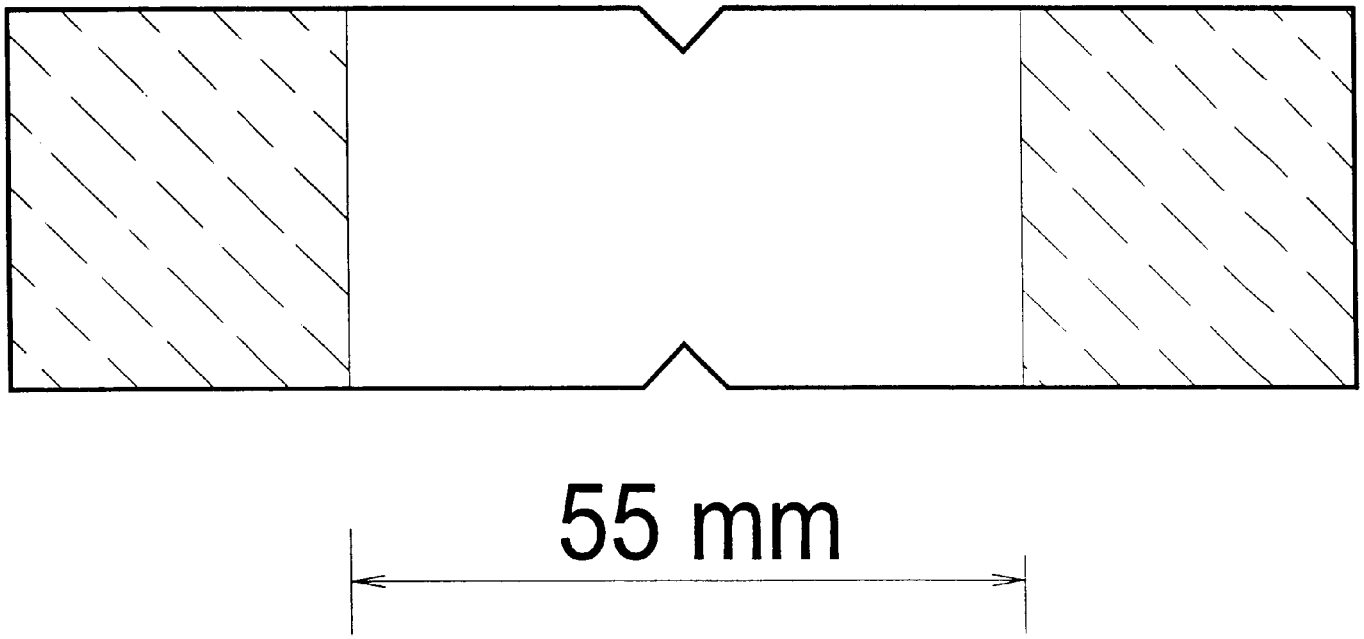
FIG. 5 is the metal matrix composite test specimen of FIG. 4 with gripped ends subjected to tension.
Figure 6:
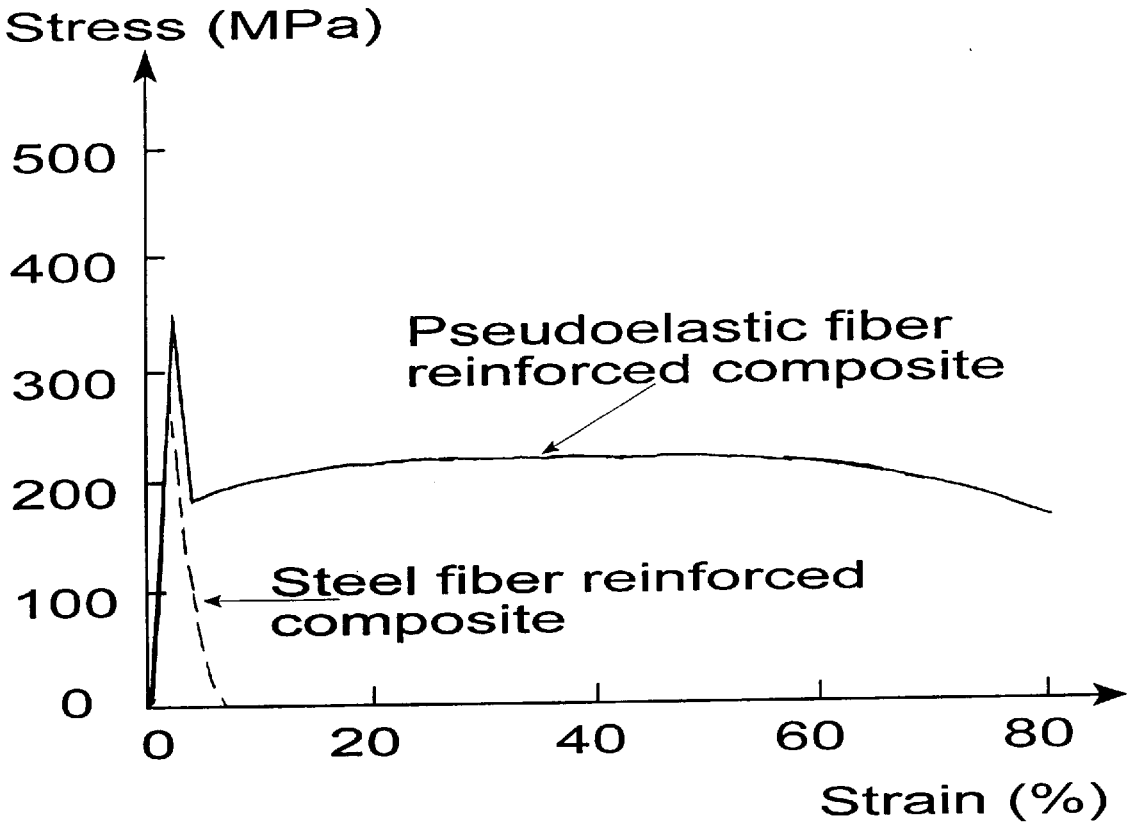
FIG. 6 is a graph showing the tensile stress-strain relationships of pseudoelastic and steel fiber reinforced metal matrix composites.

A metal matrix composite comprising 30% volume fraction of pseudoelastic fibers was manufactured in a heated press under vacuum. The pseudoelastic shape memory fibers were 0.2 mm diameter Ni—Ti—Cr alloys which were cold drawn 64%; this alloy had 55.7 wt. % Ni and 0.3 wt. % Cr. Control composite systems with QQ-W-470B steel fibers of 0.22 mm diameter were also manufactured following the same procedures as used for the pseudoelastic fiber reinforced composites. The metal matrix was 6061 aluminum in the form of 0.3 mm thick foils. Both the aluminum foil and fibers were acid cleaned using a water-based acidic surface cleaner, and then neutralized in a water-based neutralizer. The fibers, spaced equally, were then stacked with aluminum foils. The stacked system was loaded into a BN powder coated steel heated press, and consolidated at 535 degrees C under $10^{-5}$ mm Hg vacuum and 75 MPa consolidation pressure for 15 minutes. This vacuum hot pressing is the quintessential diffusion bonding process for metal matrix composites. The resulting composites were about 0.9 mm thick. Immediately after diffusion bonding in the heated press, the composites were quenched in water at 80 degrees C and then heat treated at 180° C. for 480 minutes to promote precipitation hardening. Notched tension specimens with dimensions shown in FIG. 4 were cut out of the composites. These specimens were placed in end grips and subjected to tension as shown in FIG. 5. The tensile stress-strain relationships for pseudoelastic and steel fiber reinforced metal matrix composites are shown in FIG. 6. Stress was defined here as load divided by the cross-sectional area of the composite. Strain was measured over a gage length of 25 mm. The pseudoelastic fiber reinforced composite system is observed to offer a deformation capacity which is more than 1000% larger than that offered by the steel fiber reinforced composite system. The energy absorption capacity, represented by the area under the stress-strain curve, also increases by about 2000%.

The above improvements in energy absorption capacity are far greater than those reported in the prior art. For example, U.S. Pat. No. 5,614,305 to Paine et al. reports improvements of about 100% or less in the impact strength of polymer matrix composites.

I claim:

1. A ductile composite material having increased ductility and energy absorption capacity, comprising a metal matrix and a plurality of continuous shape-memory fibers embedded within said matrix such that when the matrix experiences a localized failure therein, associated fiber tensile strains in said shape-memory fibers extending through said localized failure cause debonding of said fibers from the matrix to an extent that said fibers do not all rupture at said localized failure.

2. A ductile composite material according to claim 1, wherein the fiber tensile strains cause at least some of said shape-memory fibers to rupture at random locations therealong.

3. A ductile composite material according to claim 1, wherein said shape-memory fibers behave substantially as individual fibers when debonded from said matrix by said fiber tensile strains.

4. The composite material of claim 1, wherein said shape-memory fibers are pseudoelastic fibers.

5. The composite material of claim 1, wherein said shape-memory fibers are subjected to tension to impose sustained stresses on the matrix.

6. The composite material of claim 1, wherein said shape-memory fibers are selected from the group consisting of Ni, Ag, Au, Cd, In, Ga, Si, Ge, Sn, Sb, Zn, Nb, Cu, Co, Fe, Mn, Pt, Al, Ti, Cr, Be, C and Tl, and combinations thereof.

7. The composite material of claim 1, wherein said metal matrix is selected from the group consisting of Cu, Fe, Ni, Ti, Al, Mg, Be, Pb, W, Zn, Co, Cr, Mn, Cd and Sn, and alloys thereof.

8. The composite material of claim 1, wherein a volume fraction of said shape-memory fibers in said matrix ranges from 0.1% to 75%.

9. The composite material of claim 1, wherein, in addition to said shape-memory fibers, at least one of synthetic, mineral and organic fibers which do not exhibit shape-memory characteristics are present at 0.1% to 75% by volume in said matrix.

10. The composite material of claim 1, wherein said shape-memory fibers are distributed uniformly within a volume of said matrix.

11. The composite material of claim 1, wherein at least some of said shape-memory fibers are concentrated in at least one area within said matrix.

12. The composite material of claim 1, wherein said shape-memory fibers are aligned in at least one direction within said matrix.

13. The composite material of claim 1, wherein at least some of said shape-memory fibers are randomly oriented in two or three dimensions in said matrix.

14. An energy absorbing arrangement comprising shape-memory fibers wherein at least at one of the two ends of the fiber is embedded within a metal matrix materials, said fibers being capable of being pull out of the matrix which provides substantial energy absorption when the matrix is subjected to load.

* * * * *